US006705297B2

(12) United States Patent
Takeda et al.

(10) Patent No.: US 6,705,297 B2
(45) Date of Patent: Mar. 16, 2004

(54) FUEL PUMP FOR AN INTERNAL COMBUSTION ENGINE

(75) Inventors: Keiso Takeda, Mishima (JP); Kiyokazu Akiyama, Okazaki (JP); Tatsushi Nakashima, Anjo (JP); Kimitaka Saito, Nagoya (JP)

(73) Assignees: Toyota Jidosha Kabushiki Kaisha, Toyota (JP); Nippon Soken, Inc., Nishio (JP)

( * ) Notice: Subject to any disclaimer, the term of this patent is extended or adjusted under 35 U.S.C. 154(b) by 7 days.

(21) Appl. No.: 10/073,177

(22) Filed: Feb. 13, 2002

(65) Prior Publication Data

US 2002/0117155 A1 Aug. 29, 2002

(30) Foreign Application Priority Data

Feb. 23, 2001 (JP) ..... 2001-049047

(51) Int. Cl.[7] ..... F02M 55/02
(52) U.S. Cl. ..... 123/504; 123/90.18; 123/387
(58) Field of Search ..... 123/90.18, 369, 123/387, 504, 179.16, 179.17

(56) References Cited

U.S. PATENT DOCUMENTS 1,573,248 A * 2/1926 Johnsen ..... 123/369
1,694,367 A * 12/1928 Barttow ..... 123/504
2,210,067 A * 8/1940 Cummins ..... 123/504
3,618,574 A * 11/1971 Miller ..... 123/90.18
3,669,081 A * 6/1972 Monpetit ..... 123/369
4,295,798 A * 10/1981 Mcintosh ..... 417/212
4,300,509 A * 11/1981 Schechter ..... 123/499
4,347,818 A * 9/1982 Wysong ..... 123/369
4,350,128 A * 9/1982 Boudy ..... 123/369
5,255,643 A * 10/1993 Mochizuki et al. .... 123/179.17
5,511,956 A * 4/1996 Hasegawa et al. ..... 123/496
5,979,414 A * 11/1999 Pugh ..... 123/504
6,453,879 B2 * 9/2002 Joos et al. ..... 123/497
6,561,150 B1 * 5/2003 Kikuoka et al. ..... 123/90.18

FOREIGN PATENT DOCUMENTS

JP 2000-45905 A 2/2000

* cited by examiner

*Primary Examiner*—Thomas N. Moulis
(74) *Attorney, Agent, or Firm*—Oliff & Berridge, PLC

(57) ABSTRACT

A fuel pump for an internal combustion engine that transmits fuel with pressure by a lifting movement of a plunger that is caused to lift by a movement of a cam includes a lift amount changing mechanism. The lift amount changing mechanism includes a cam in which a height of a projection is varied along an axial direction of the camshaft, and a cam moving actuator that moves the cam along the axial direction of the camshaft. The lift amount of the plunger is changed by moving the cam along the axial direction of the camshaft. An amount of discharged fuel is controlled by changing the amount of discharged fuel per stroke of the plunger and is not determined only based upon the rotation speed of the engine. Therefore, the amount of discharged fuel can be increased with the engine rotated at a low speed, for example when the engine is being initially started, to improve a starting performance.

15 Claims, 7 Drawing Sheets

FUEL PUMP FOR AN INTERNAL COMBUSTION ENGINE

INCORPORATED BY REFERENCE

The disclosure of Japanese Patent Application No. 2001-049047 filed on Feb. 23, 2001, including the specification, drawings and abstract is incorporated herein by reference in its entirety.

BACKGROUND OF THE INVENTION

1. Field of Invention

This invention relates to a fuel pump for an internal combustion engine.

2. Description of Related Art

Fuel pumps for internal combustion engines have been widely utilized as a system for supplying fuel with high pressure for a direct-injection internal combustion engine in a cylinder. According to this type of fuel pump, fuel is generally transmitted under pressure by a lifting movement of a plunger in a cylinder of a pump. The lifting movement of the plunger is produced corresponding to a movement of a cam.

FIG. 7 illustrates a schematically sectional view of one example of conventional fuel pumps for internal combustion engines. According to a fuel pump 100, fuel is introduced from a fuel supply port 107 and is pressurized by the lifting movement of a plunger 102 in a chamber 101 defined in a cylinder 106 at the center of the pump. The pressurized fuel is then discharged from a fuel discharging port 108. That is, the plunger 102 inserted in the cylinder 106 is provided with a tappet 109 at a bottom portion of the plunger 102. The plunger 102 is normally biased by a spring in a direction of a cam 103.

Corresponding to an initial start of the internal combustion engine (engine), fuel is introduced into the chamber 101 in the cylinder 106. An electromagnetic valve 105 serving as a fuel introducing valve is hence closed. A rotation of the internal combustion engine, i.e. a rotation of a crankshaft, is transmitted to a camshaft 104 via a power transmitting mechanism. The cam 103 then comes into contact with the tappet 109 and is rotatably driven. The cam 103 is formed to have a fixed sectional shape (cam profile) with a few (1 to 3) circular projecting portions, i.e. projections. Therefore, the lifting movement of the plunger 102 is produced when the projections of the cam 103 come into contact with the tappet 109 and push the tappet 109 upward. The volume of the chamber 101 is hence decreased and fuel is pressurized and discharged. The cam 103 is further rotated and the projections of the cam 103 are separated from the tappet 109. The plunger 102 is then returned to the cam 103 by the spring so that the volume of the chamber 101 is increased. In this case, the fuel introducing valve 105 is opened and new fuel is introduced into the chamber 101.

Fuel is transmitted with pressure by repeating the above-described cycle. However, according to the conventional fuel pump for the internal combustion engine, a sufficient amount of discharged fuel could not probably be ensured for obtaining fuel pressure (injection pressure) required by the internal combustion engine especially when the engine is rotated at a low speed, for example when the engine is initially started.

That is, a lift amount by the lifting movement of the plunger is fixed. A frequency of the lifting movements of the plunger, i.e. the number of strokes per unit of time, is determined by the rotation speed of the engine (r.p.m.). Therefore, when the engine is rotated at a low speed, for example when the engine is initially started, an amount of discharged fuel per unit of time is decreased. Further, when the engine is rotated at a low speed, for example when the engine is initially started, a compressing cycle by the plunger requires a long time. Therefore, the amount of fuel leaked from a clearance between the plunger and the cylinder is increased so that an actual amount of discharged fuel per stroke is decreased. Further, a required amount of fuel injected at a cold start is from two to four times as large as the required amount of fuel injected under the vehicle being normally running.

As a result, the conventional fuel pump for the internal combustion engine may have a problem in that a good performance can not obtained at starting because a desirable fuel injection can not be ensured when the engine is initially started.

SUMMARY OF THE INVENTION

Considering the above-described problem, according to the invention, an amount of discharged fuel is increased to obtain a required fuel pressure (injection pressure) when an engine is rotated at a low speed, for example when the engine is initially started. Further, a fuel pump for an internal combustion engine is provided for varying the amount of discharged fuel amount to improve the starting performance.

A fuel pump for an internal combustion engine according to one of the embodiments of the invention transmits fuel with pressure by a lifting movement of a plunger that is caused to lift by a movement of a cam connected to a camshaft. The fuel pump for the internal combustion engine is provided with a lift amount changing mechanism that changes a lift amount of the plunger caused by the cam.

Since this type of fuel pump for the internal combustion engine is provided with a lift amount changing mechanism, the lift amount of the plunger caused by the cam can be varied. Therefore, an amount of discharged fuel per stroke of the plunger is changed and is not determined based only upon a rotation speed of the engine. Therefore, a control of the amount of discharged fuel of the pump can be performed as required. Accordingly, required fuel pressure (injection pressure) can be obtained by increasing the amount of discharged fuel even when the engine is rotated at a low speed, for example when the engine is initially started, so that a starting performance can be improved.

A fuel pump for an internal combustion engine of one of the other embodiments of the invention transmits fuel with pressure by a lifting movement of a plunger that is caused to lift by a movement of a cam connected to a camshaft. The fuel pump for the internal combustion engine is provided with a lift number changing mechanism that changes the number of the lifting movements of the plunger that occur per rotation of the internal combustion engine.

Since this type of fuel pump for the internal combustion engine is provided with the lift number changing mechanism, the number of the lifting movements of the plunger that occur per rotation of the internal combustion engine can be varied. Therefore, the amount of discharged fuel per rotation of the internal combustion engine is changed and is not determined only based upon the rotation speed of the engine. Therefore, a control of the amount of discharged fuel of the pump can be performed as required. Accordingly required fuel pressure (injection pressure) can be obtained by increasing the amount of discharged fuel even when the engine is rotated at a low speed, for example when the engine is initially started, to improve a starting performance.

Further, a fuel pump for an internal combustion engine according to one of the other embodiments of the invention transmits fuel with pressure by a lifting movement of a plunger that is caused to lift by a movement of a cam connected to a camshaft. The fuel pump for the internal combustion engine is provided with a speed changing mechanism that changes a rotation speed of the internal combustion engine, transmits the changed rotation speed to the camshaft, and changes a speed change ratio between the rotation speed of the internal combustion engine and a rotation speed of the camshaft.

Since this type of fuel pump for the internal combustion engine is provided with the speed changing mechanism, the number of the lifting movements of the plunger per rotation of the internal combustion engine can be changed by this speed changing mechanism. Therefore, the amount of discharged fuel per rotation of the internal combustion engine is changed and is not determined only based upon the rotation speed of the engine. Accordingly, a control of the amount of discharged fuel of the pump can be performed as required. Therefore, required fuel pressure (injection pressure) can be obtained by increasing the amount of discharged fuel even when the engine is rotated at a low speed, for example when the engine is initially started, to improve a starting performance.

BRIEF DESCRIPTION OF THE DRAWINGS

The above mentioned and other objects, features, advantages, technical and industrial significance of this invention will be better understood by reading the following detailed description of the preferred embodiments of the invention, when considered in connection with the accompanying drawings, in which:

FIGS. 2*a*–2*c* are enlarged views of a cam portion of the fuel pump for the internal combustion engine illustrated in FIG. 1, wherein FIG. 2*a* is a side view, FIG. 2*b* is a sectional view taken along line 2—2 in FIG. 2*a*, and FIG. 2*c* is a sectional view taken along line 3—3 in FIG. 2*a;*

FIGS. 3*a*–3*c* are enlarged views of a cam portion of a fuel pump for an internal combustion engine according to a second embodiment of the invention, wherein FIG. 3*a* is a side view, FIG. 3*b* is a sectional view taken along line 2—2 in FIG. 3*a*, and FIG. 3*c* is a sectional view taken along line 3—3 in FIG. 3*a;*

FIGS. 4*a*–4*d* are enlarged views of a modified example of the cam portion of the fuel pump for the internal combustion engine according to the second embodiment of the invention, wherein FIG. 4*a* is a side view, FIG. 4*b* is a sectional view taken along line 2—2 in FIG. 4*a*, FIG. 4*c* is a sectional view taken along line 3—3 in FIG. 4*a*, and FIG. 4*d* is a sectional view taken along line 4—4 in FIG. 4*a;*

DETAILED DESCRIPTION OF PREFERRED EMBODIMENTS

Figure 1:
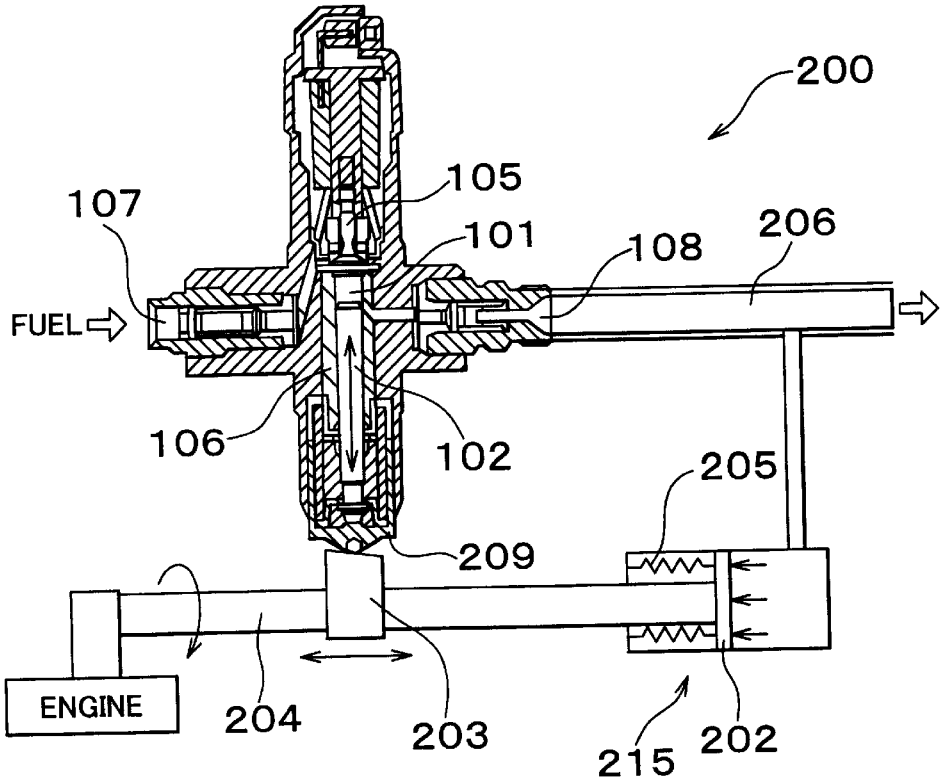
FIG. 1 is a sectional view schematically illustrating a structure of a fuel pump for an internal combustion engine according to a first embodiment of the invention.

Hereinafter, embodiments according to the present invention will be described in detail with reference to the drawings. In the drawings, identical or similar elements will be denoted with the same reference numerals.

Figure 7:
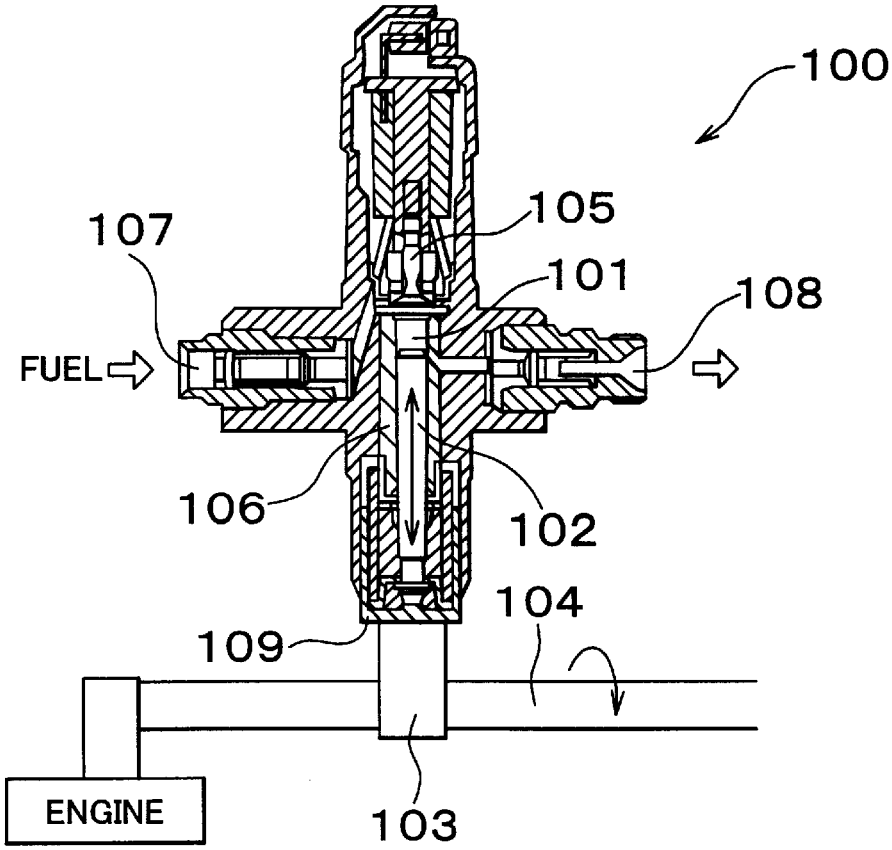
FIG. 7 is a sectional view schematically illustrating a structure of a conventional fuel pump for an internal combustion engine.

FIG. 1 is a schematically sectional view of a fuel pump 200 of a first embodiment of a fuel pump for an internal combustion engine for discharging variable amount of fuel according to the invention. In the fuel pump 200 according to the first embodiment, a basic principle to transmit fuel with pressure by a lifting movement of a plunger corresponding to a movement of a cam is the same as a conventional fuel pump 100 illustrated in FIG. 7. Therefore, the fuel pump 200 according to the first embodiment is formed of the same basic structure as the conventional fuel pump 100. That is, the fuel pump 200 according to the first embodiment is provided with a cam 203 mounted on a camshaft 204, a tappet 209 engaged with the cam 203, a plunger 102 having the tappet 209 at one end portion thereof, a cylinder 106 receiving the plunger 102 therein, and a chamber 101 defined in the cylinder 106. The fuel pump 200 is further provided with a fuel supply port 107, a fuel discharge port 108 both of which are connected to the chamber 101, and an electromagnetic valve 105. The electromagnetic valve 105 is disposed halfway in a passage connecting the fuel supply port 107 and the chamber 101 and serves as a fuel introducing valve. The plunger 102 and the tappet 209 engaged with the plunger 102 are biased by a spring (not shown) in a direction of the cam 203. The cam 203 is rotatably driven by a rotation of an engine transmitted to the camshaft 204, i.e. a rotation of a crankshaft transmitted to the camshaft 204.

Figure 2A:
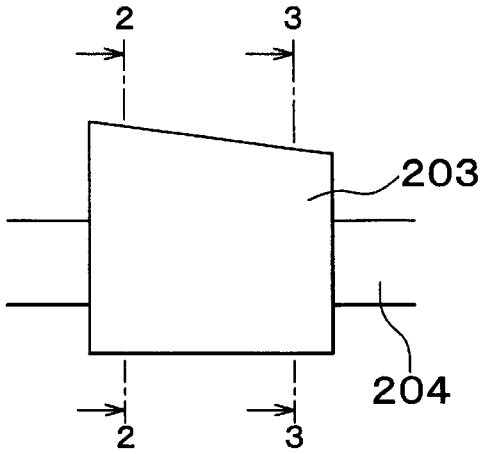
Figure 2B:
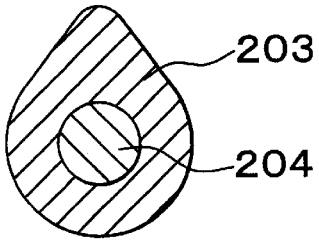
Figure 2C:
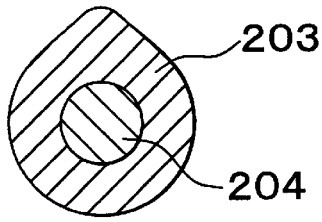

According to the first embodiment, the tappet 209 is pushed upward corresponding to the rotation of the cam 203 so that a lift movement of the plunger 102 is performed in the cylinder 106. Therefore, fuel is transmitted with pressure in the same manner as the conventional fuel pump 100. A cam 103 of the conventional fuel pump 100 has an even (i.e. a constant) cam profile (in any section) along an axial direction of a camshaft 104. To the contrary, the cam 203 has an uneven profile along the axial direction of the camshaft 204. In particular, the cam 203 has a cam profile in which heights (dimensions) of a projection are varied as illustrated in FIGS. 2*a*, 2*b*, and 2*c*.

According to the above-described cam shape, the lift amount of the plunger 102 can be varied corresponding to the movement of the cam 203 along the axial direction of the camshaft 204. Therefore, the amount of discharged fuel can be varied. That is, when the cam 203 is moved so that a high portion of the projection is engaged with the tappet 209, the lift amount becomes larger and the amount of discharged fuel is increased. To the contrary, when the cam is moved so that a low portion of the projection is engaged with the tappet 209, the lift amount becomes smaller and the amount of discharged fuel can be decreased. According to an arrangement structure illustrated in FIG. 1, when the cam 203 is moved to the right side, the amount of discharged fuel is increased. When the cam 203 is moved to the left side, the amount of discharged fuel is decreased. An engaging portion of the tappet 209 with the cam 203 according to the first embodiment does not prevent the cam 203 from moving in the axial direction of the camshaft 204 and is formed to follow a surface of the rotatable cam 203.

Further, according to the first embodiment, the fuel pump 200 is provided with a cam moving apparatus 215 as being schematically illustrated in FIG. 1. The cam moving apparatus 215 moves the cam 203 along the axial direction of the camshaft 204 corresponding to a fuel pressure in a fluid discharging side passage 206 of the fuel pump 200. The cam moving apparatus 215 is in a form of a housing structure having a movable wall 202. An inner space of the housing is connected to the fuel discharging side passage 206 of the fuel pump 200. The camshaft 204 is rotatably connected to the movable wall 202. The movable wall 202 is biased by a spring 205 in a direction to decrease the volume of the inner space of the housing. According to the arrangement structure illustrated in FIG. 1, when the fuel pressure in the fuel discharging side passage 206 is increased, the movable wall 202 is moved to the left side in FIG. 1 by the fuel pressure overcoming a spring force. The cam 203 is then moved to the left side. On the other hand, when the fuel pressure in the fuel discharging side passage 206 of the fuel pump 200 is decreased, the movable wall 202 is moved to the right side in FIG. 1 by the spring force overcoming the fuel pressure. The cam 203 is then moved to the right side.

As being fully described above, according to the fuel pump 200 of the first embodiment of the invention illustrated in FIG. 1, when the fuel pressure in the fuel discharging side passage 206 of the fuel pump 200 is low, the cam 203 is moved to the right side and the amount of discharged fuel is increased. When the fuel pressure in the fuel discharging side passage 206 of the fuel pump 200 is high, the cam 203 is moved to the left side and the amount of discharged fuel is decreased. That is, according to the above-described structure, a control of the amount of discharged fuel can be performed corresponding to the fuel pressure only by adding a simple structure without using a sensor, an actuator and the like.

According to the above described structure, when the fuel pressure is low, for example when the engine is initially started, the cam 203 is moved to the right side in FIG. 1 and the lift amount of the plunger 102 is increased so that the amount of discharged fuel is increased. On the other hand, when the fuel pressure is sufficiently high, for example when the vehicle is normally running, the cam 203 is moved to the left side in FIG. 1 and the lift amount of the plunger 102 is decreased so that excessive fuel is not discharged.

Next, a fuel pump for an internal combustion engine according to a second embodiment of the invention will be described. An entire structure of the fuel pump according to the second embodiment is the same as the fuel pump 200 according to the first embodiment illustrated in FIG. 1, yet a cam shape is not the same. More specifically, a cam 210 according to the second embodiment has a cam profile in which the number of projections is varied as illustrated in FIGS. 3*a*, 3*b*, and 3*c*.

According to the above described cam shape, the number of the lifting movements of the plunger 102 per rotation of the camshaft 204 can be varied corresponding to the movement of the cam 210 along the axial direction of the camshaft 204. Therefore, the amount of discharged fuel can be varied. That is, the number of the lifting movements is increased and the amount of discharged fuel is increased when the cam 210 is moved for engaging the tappet 209 with a many projections portion. On the other hand, the number of the lifting movements is decreased and the amount of discharged fuel is decreased when the cam 210 is moved for engaging the tappet 209 with a less projections portion.

Figure 3A:
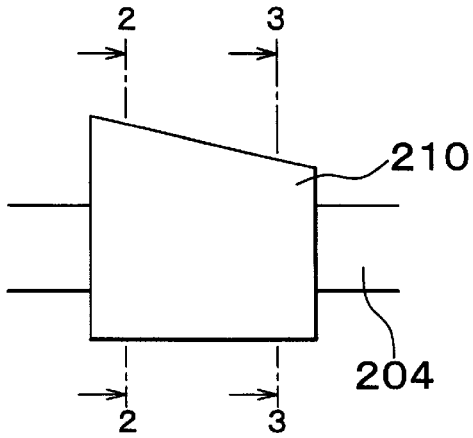
Figure 3B:
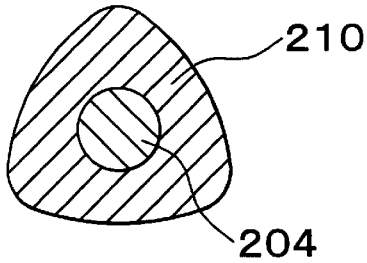
Figure 3C:
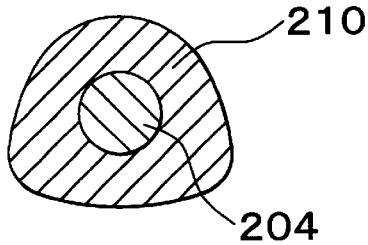
Figure 4A:
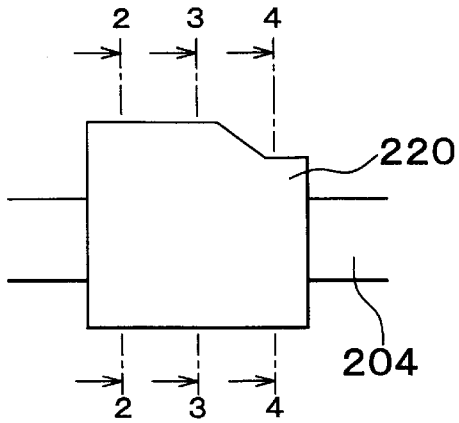
Figure 4B:
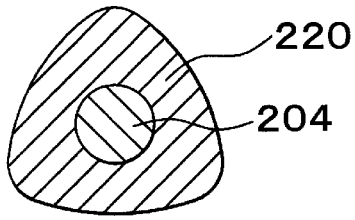
Figure 4C:
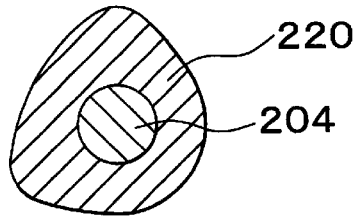
Figure 4D:
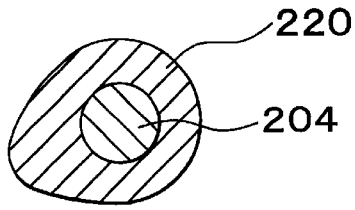

According to the arrangement structure illustrated in FIG. 3*a*, the amount of discharged fuel is increased when the cam 210 is moved to the right side, and the amount of discharged fuel is decreased when the cam 210 is moved to the left side. Herein, the camshaft 204 is applied with the rotation of the crankshaft, i.e. the rotation of the engine at a constant speed change ratio, to be rotatably driven. Therefore, to change the number of the lifting movements of the plunger 102 per rotation of the camshaft 204 means to change the number of the lifting movements of the plunger 102 per rotation of the internal combustion engine.

According to the second embodiment, since the apparatus for moving the cam 210 along the axial direction of the camshaft 204 corresponding to the fuel pressure in the fuel discharging side passage of the fuel pump according to the first embodiment illustrated in FIG. 1 is provided, the control of the amount of discharged fuel is performed corresponding to the fuel pressure in the fuel discharging side passage of the fuel pump in the same manner as the first embodiment when the cam 210 is mounted on the camshaft 204 in a proper direction. That is, according to the fuel pump illustrated in FIG. 1, with the cam 203 replaced by the cam 210 placed in a direction illustrated in FIG. 3*a*, the cam 210 is moved to the right side in FIG. 1 and the number of the lifting movements of the plunger 102 is increased when the fuel pressure is low, for example when the engine is initially started. On the other hand, the cam 210 is moved to the left side in FIG. 1 and the number of the lifting movements of the plunger 102 is decreased when the fuel pressure has been sufficiently high, for example when the vehicle is normally running. Therefore, excessive fuel pressure is not discharged.

Figure 5:
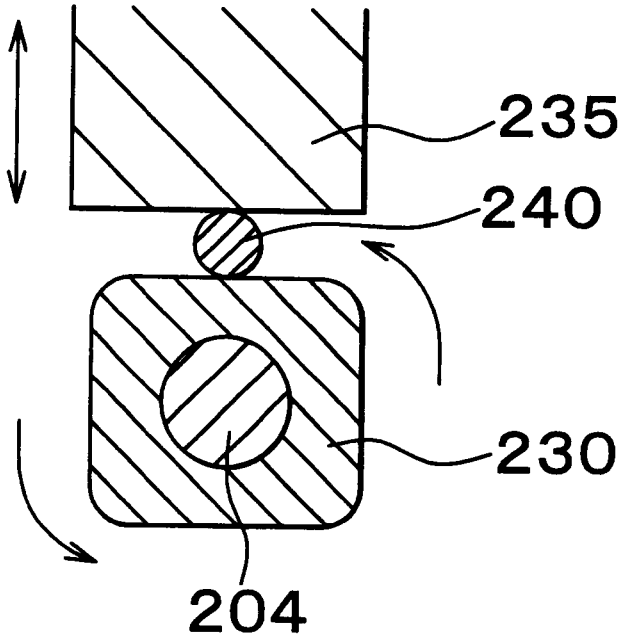
FIG. 5 is a sectional view of another modified example of the cam portion of the fuel pump for the internal combustion engine according to the second embodiment of the invention.

According to the second embodiment, the cam 210 was described. The cam 210 described above has two cam profile portions; one is a cam profile portion with three projections illustrated in FIG. 3*b* and the other one is a cam profile portion with two projections illustrated in FIG. 3*c*. However, the number of projections of the cam profile can be freely selected as desired. Further, the number of portions having different projections can be freely selected as desired. FIGS. 4*a* through 4*d* illustrate a cam 220 according to a modified example of the invention. The cam 220 includes three cam profiles. The first one is a cam profile with three projections, the second one is a cam profile with two projections, and the third one is a cam profile with a single projection. When the cam 220 includes a cam profile with four projections or more than that, the cam 220 can not be rotated with a point in contact with the tappet. Therefore, as illustrated in FIG. 5, another disc cam 240 is required to be disposed between a cam 230 and a tappet 235 as being illustrated in FIG. 5.

Next, a fuel pump 700 for an internal combustion engine according to a third embodiment is described. A structure of the fuel pump 700 according to the third embodiment is substantially the same as the aforementioned conventional fuel pump except for an apparatus for transmitting the rotation of the internal combustion engine, the rotation of a crankshaft 705 to a camshaft 701. As described above, according to the conventional fuel pump, the rotation of the crankshaft is generally transmitted to the camshaft via a belt and the like. If that is the case, a speed change ratio between the crankshaft rotation speed and the camshaft rotation speed is fixed. Therefore, a frequency of the lifting movements of the plunger of the fuel pump is determined only by the rotation speed of the crankshaft, i.e. by the rotation speed of the engine. The amount of discharged fuel is also determined only by the rotation speed of the engine. On the other hand, according to the third embodiment, the rotation of the crankshaft 705 is transmitted to the camshaft 701 via a speed changing mechanism 702. Therefore, the speed changing mechanism 702 can change the speed change ratio between the rotation speed of the crankshaft and the rotation speed of the camshaft.

The speed changing mechanism 702 according to the third embodiment is provided with a driving pulley 707 disposed on the crankshaft 705 and a driven pulley 709 disposed on the camshaft 701, and a speed changing belt 704. The speed changing belt 704 is arranged for transmitting rotation between the pulleys 707 and 709. The speed changing mechanism 702 according to the third embodiment is further provided with a belt moving apparatus 715. The belt moving apparatus 715 according to the third embodiment moves the speed changing belt 704 along an axial direction of the camshaft 701. According to the third embodiment, the belt moving apparatus 715 moves the speed changing belt 704 along the axial direction of the camshaft 701 corresponding to the fuel pressure in the fuel discharging side passage 706.

Figure 6:
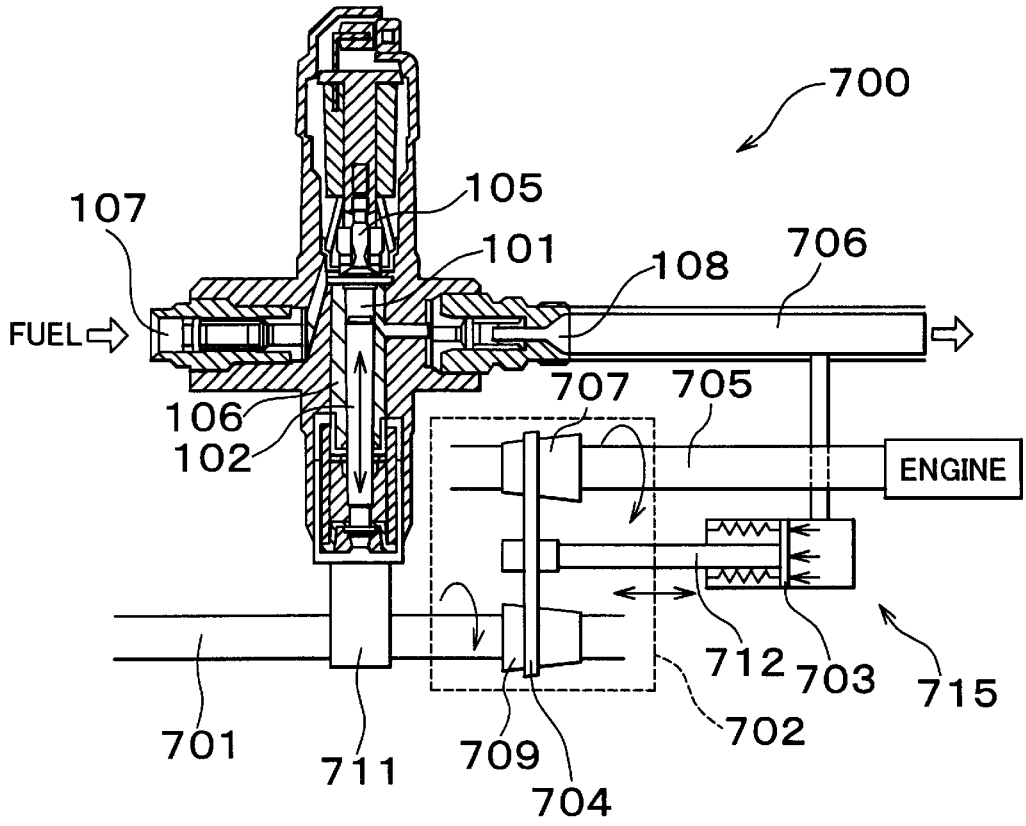
FIG. 6 is a sectional view schematically illustrating a structure of a fuel pump for an internal combustion engine according to a third embodiment of the invention.

The driving pulley 707 and the driven pulley 709 respectively have a sectional diameter gradually increasing or decreasing along the rotation axis. Both of the pulleys 707 and 709 are in the form of a cone without a cone tip. As illustrated in FIG. 6, a large diameter portion of the pulley 707 and a small diameter portion of the pulley 709 are arranged to face in one direction. On the other hand, a small diameter portion of the pulley 707 and a large diameter portion of the pulley 709 are arranged to face in the other direction. The speed changing belt 704 is arranged on an inclined side surface of each pulley 707 and 709.

According to the above-described structure, when the speed changing belt 704 is moved along the axial direction of the camshaft 701 per rotation of the crankshaft of the internal combustion engine, the rotating number of the camshaft 701, i.e. a rotating number of a cam 711 per rotation of the crankshaft of the internal combustion engine can be changed. Therefore, the lifting number of the plunger 102 can be changed and the amount of discharged fuel can be changed. That is, according to the arrangement structure illustrated in FIG. 6, when the speed changing belt 704 is moved to the right side in FIG. 6, the large diameter portion of the driving pulley 707 and the small diameter portion of the driven pulley 709 are connected by the speed changing belt 704. Therefore, the speed change ratio is changed to increase the rotation speed of the camshaft 701. As a result, the lifting number of the plunger 102 is increased and the amount of discharged fuel is increased. On the other hand, when the speed changing belt 704 is moved to the left side in FIG. 6, the small diameter portion of the driving pulley 707 and the large diameter portion of the driven pulley 709 are connected by the speed changing belt 704. Therefore, the speed change ratio is changed to decrease the rotation speed of the camshaft 701. As a result, the lifting number of the plunger 102 is decreased and the amount of discharged fuel is decreased.

As described above, according to the third embodiment, the belt moving apparatus 715 is provided for moving the speed changing belt 704 along the axial direction of the camshaft 701 corresponding to the fuel pressure in the fuel discharging side passage 706. Therefore, the above-described control of the amount of discharged fuel is performed corresponding to the fuel pressure in the fuel discharging side passage 706. A basic structure of the belt moving apparatus 715 according to the third embodiment is the same as the cam moving apparatus 215 for moving the cam along the axial direction of the camshaft corresponding to the fuel pressure in the fuel discharging side passage of the fuel pump described for the first and second embodiments of the invention. However, a movable wall 703 of the belt moving apparatus 715 is connected to a transmitting means 712 for transmitting a displacement of the movable wall 703 to the speed changing belt 704 instead of being connected to the camshaft.

As fully described above, according to the fuel pump 700 of the third embodiment of the invention illustrated in FIG. 6, when the fuel pressure in the fuel discharging side passage 706 of the fuel pump 700 is low, the speed changing belt 704 is moved to the right side in FIG. 6 and the amount of discharged fuel is increased. When the fuel pressure in the fuel discharging side passage 706 of the fuel pump 700 is high, the speed changing belt 704 is moved to the left side in FIG. 6 and the amount of discharged fuel is decreased.

According to the above-described structure, when the fuel pressure is low, for example, when the engine is initially started, the amount of discharged fuel is increased. On the other hand, when the fuel pressure is sufficiently high, for example when the vehicle has been normally running, excessive fuel is not discharged.

As fully described above, according to the third embodiment, a mounting direction of the driving pulley 707 and the driven pulley 709 is determined considering a moving direction of the belt moving apparatus 715 against a change of the fuel pressure in the fuel discharging side passage.

Further, if desired, the control of the amount of discharged fuel can be performed by combining a lift amount changing apparatus for changing the lift amount of the plunger according to the first embodiment and a lifting number changing apparatus for changing the lifting number according to the second embodiment.

While the invention had been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A fuel pump for an internal combustion engine for transmitting fuel with pressure by a lifting movement of a plunger that is caused to lift by a movement of a cam connected to a camshaft, comprising:

a lift amount changing mechanism that changes a lift amount of the plunger caused by the cam, wherein the lift amount changing mechanism changes the lift amount corresponding to a fuel pressure in a fuel discharging side passage of the fuel pump.

2. A fuel pump for an internal combustion engine according to claim 1, wherein the lift amount changing mechanism includes the cam in which a height of a projection of the cam is varied along an axial direction of the camshaft, and a cam moving actuator that moves the cam along the axial direction of the camshaft.

3. A fuel pump for an internal combustion engine according to claim 2, wherein the cam moving actuator is driven using a fuel pressure in a fuel discharging side passage of the fuel pump.

4. A fuel pump for an internal combustion engine according to claim 1, wherein a speed changing mechanism is provided for changing a speed change ratio between a rotation speed of the internal combustion engine and a rotation speed of the camshaft.

5. A fuel pump for an internal combustion engine according to claim 4, wherein the speed changing mechanism includes a first pulley provided on a shaft connected to the internal combustion engine, a second pulley provided on the camshaft, and a belt wound on the first and second pulleys.

6. A fuel pump for an internal combustion engine for transmitting fuel with pressure by a lifting movement of a plunger that is caused to lift by a movement of a cam connected to a camshaft, comprising:

a lift number changing mechanism that changes the number of the lifting movements of the plunger that occur per rotation of the camshaft.

7. A fuel pump for an internal combustion engine according to claim 6, wherein the lift number changing mechanism changes the number of the lifting movements corresponding to a fuel pressure in a fuel discharging side passage of the fuel pump.

8. A fuel pump for an internal combustion engine according to claim 7, wherein a speed changing mechanism is provided for changing a speed change ratio between a rotation speed of the internal combustion engine and a rotation speed of the camshaft.

9. A fuel pump for an internal combustion engine according to claim 6, wherein the lift number changing mechanism includes the cam in which a number of projections around a periphery of the cam is varied along an axial direction of the camshaft, and a cam moving actuator that moves the cam along the axial direction of the camshaft.

10. A fuel pump for an internal combustion engine according to claim 9, wherein the cam moving actuator is driven using a fuel pressure in a fuel discharging side passage of the fuel pump.

11. A fuel pump for an internal combustion engine according to claim 9, wherein a disc cam is disposed between the cam and the plunger to convert a rotating movement of the cam to the lifting movement of the plunger.

12. A fuel pump for an internal combustion engine according to claim 6, wherein a speed changing mechanism is provided for changing a speed change ratio between a rotation speed of the internal combustion engine and a rotation speed of the camshaft.

13. A fuel pump for an internal combustion engine according to claim 12, wherein the speed changing mechanism includes a first pulley provided on a shaft connected to the internal combustion engine, a second pulley provided on the camshaft, and a belt wound on the first and second pulleys.

14. A fuel pump for an internal combustion engine for transmitting fuel with pressure by a lifting movement of a plunger that is caused to lift by a movement of a cam connected to a camshaft, comprising:

a speed changing mechanism that changes a speed change ratio between the rotation speed of the internal combustion engine and a rotation speed of the camshaft, wherein the speed changing mechanism changes the speed change ratio corresponding to a fuel pressure in a fuel discharging side passage of the fuel pump.

15. A fuel pump for an internal combustion engine according to claim 14, wherein the speed changing mechanism includes a first pulley provided on a shaft connected to the internal combustion engine, a second pulley provided on the camshaft, and a belt wound on the first and second pulleys.

* * * * *